US007075393B2

(12) United States Patent
Majumder et al.

(10) Patent No.: US 7,075,393 B2
(45) Date of Patent: Jul. 11, 2006

(54) MICROMACHINED RELAY WITH INORGANIC INSULATION

(75) Inventors: Sumit Majumder, Malden, MA (US); Kenneth Skrobis, Maynard, MA (US); Richard H. Morrison, Taunton, MA (US)

(73) Assignee: Analog Devices, Inc., Norwood, MA (US)

( * ) Notice: Subject to any disclaimer, the term of this patent is extended or adjusted under 35 U.S.C. 154(b) by 61 days.

(21) Appl. No.: 10/694,262

(22) Filed: Oct. 27, 2003

(65) Prior Publication Data

US 2004/0196124 A1 Oct. 7, 2004

Related U.S. Application Data

(60) Provisional application No. 60/421,162, filed on Oct. 25, 2002.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,638,946 | A | 6/1997 | Zavracky | |
| 6,094,116 | A * | 7/2000 | Tai et al. | 335/78 |
| 6,153,839 | A * | 11/2000 | Zavracky et al. | 200/181 |
| 6,307,452 | B1 | 10/2001 | Sun | |
| 6,531,668 | B1 * | 3/2003 | Ma | 200/181 |
| 6,872,902 | B1 * | 3/2005 | Cohn et al. | 200/181 |
| 6,875,936 | B1 * | 4/2005 | Suzuki et al. | 200/181 |
| 2002/0146919 | A1 | 10/2002 | Cohn | |
| 2004/0140872 | A1 * | 7/2004 | Wong | 335/78 |

FOREIGN PATENT DOCUMENTS

| | | |
|---|---|---|
| EP | 0 924 730 A1 | 6/1999 |
| WO | WO 02/32806 | 4/2002 |

* cited by examiner

*Primary Examiner*—Lincoln D. Donovan
*Assistant Examiner*—Bernard Rojas
(74) *Attorney, Agent, or Firm*—Gauthier & Connors LLP

(57) ABSTRACT

A micromechanical relay is made by surface micromachining techniques. It includes a metallic cantilever beam deflectable by an electrostatic field and a beam contact connected to the beam and electrically insulated from the beam by an insulating segment. During operation, the beam deflects, and the beam contact establishes an electrical contact between two drain electrodes.

19 Claims, 14 Drawing Sheets

MICROMACHINED RELAY WITH INORGANIC INSULATION

PRIORITY INFORMATION

This application claims priority from provisional application Ser. No. 60/421,162 filed Oct. 25, 2002, which is incorporated herein by reference in its entirety.

FIELD OF THE PRESENT INVENTION

The present invention is directed to a micromechanical relay. More particularly, the present invention is directed to a micromechanical relay with inorganic insulation made utilizing micromachining techniques.

BACKGROUND OF THE PRESENT INVENTION

Electronic measurement and testing systems use relays to route analog signals. Switching devices used in these systems are required to have a very high off-resistance and a very low on-resistance. MOS analog switches have the disadvantage of non-zero leakage current and high on-resistance.

One example of a prior art microswitch is illustrated in FIG. 1. The basic structure is a micromechanical switch that includes a source contact 14, a drain contact 16, and a gate contact 12. A conductive bridge structure 18 is attached to the source contact 14. The bridge structure 18 overhangs the gate contact 12 and the drain contact 16 and is capable of coming into mechanical and electrical contact with the drain contact 16 when deflected downward. Once in contact with the drain contact 16, the bridge 18 permits current to flow from the source contact 14 to the drain contact 16 when an electric field is applied between the source and the drain.

Thus, as shown in FIG. 2, the voltage between the gate 12 and the source 14 controls the actuation of the device by generating an electric field in the space 20. With a sufficiently large voltage in the space 20, the switch closes and completes the circuit between the source and the drain by deflecting the bridge structure 18 downwardly to contact the drain contact 16.

Switches of this type are disclosed in U.S. Pat. No. 4,674,180 to Zavracky et al.; the entire contents of U.S. Pat. No. 4,674,180 are hereby incorporated by reference. In this device, a specific threshold voltage is required to deflect the bridge structure 18 so that it may contact the drain contact 16. Once the bridge 18 comes into contact with the drain contact 16, current flow is established between the source and the drain.

To obtain consistent performance the source must always be grounded, or the driving potential between the source and the gate must be floating relative to the source potential. However, this arrangement is not acceptable for many applications.

A preferred arrangement is a device with four external terminals instead of three: a source, a gate, and a pair of drain terminals, disposed such that a driving voltage between the gate and the source actuates the device, and establishes electrical contact between the drain electrodes, but keeps the drain electrodes electrically isolated from the source and gate electrodes. The advantage of this arrangement is that the current being switched does not alter the fields used to actuate the switch. Thus, the isolated contact completes a circuit independently from the circuitry used to actuate the switch. Several electrostatic microrelays of this type have been described in the prior art.

U.S. Pat. No. 5,278,368 to Kasano et al. discloses an electrostatic microrelay with a single-crystal silicon cantilever beam suspended above a gate electrode, and a contact bar attached to, but electrically isolated from, the underside of the beam. When the beam is actuated, the contact bar creates an electrical path between a pair of drain electrodes. Additional conductors distributed below and above the beam enable bistable operation. The manufacture of such a device requires the construction and alignment of several layers of conductors and insulators.

Yao and Chang (Transducers '95 Eurosensors IX, Stockholm, Sweden (1995)) have reported a similar device, with the difference that the cantilever beam is made of silicon oxide, and isolates the source from the beam contact without requiring an additional insulating layer.

Gretillat et al. (J. Micromech. Microeng. 5, 156–160 (1995)) have reported a microrelay with a polysilicon/silicon nitride/polysilicon bridge as the mechanical element.

U.S. Pat. No. 6,162,657 to Schiele, et al. disclosed a microrelay based on a gold cantilever sandwiched between silicon oxide layers to provide curvature to the beam by residual stress action, and hence improve isolation in the off-state.

A number of electromagnetically actuated microswitches and microrelays have been described in the prior art. The use of electromagnetic actuation limits the extent to which these devices can be miniaturized, and also results in higher power consumption than electrostatic actuation.

Another electrostatic microrelay is disclosed in U.S. Pat. No. 5,638,946 to Zavracky. As disclosed by Zavracky and illustrated in FIG. 3 of the present application, a micromechanical relay 28 includes a substrate 30 and a series of contacts (32, 34, 36) mounted on the substrate. The contacts include a source contact 32, a gate contact 34, and a drain contact 36. The drain contact 36 is made up of two separate contacts that are not shown in FIG. 3.

A beam 38 is attached at one end 40 to the source contact 32 and permits the beam to hang over the substrate 30. The entire beam structure 38, which comprises three separate components (a conductive body component 44 that includes the one end 40 attached to the source contact 32, an insulative element 42, and a conductive contact 46), is of sufficient length to overhang both the gate contact 34 and the drain contact 36.

As noted above, the beam structure 38 includes an insulative element 42 that joins and electrically insulates the conductive beam body 44 from the beam contact 46. The conductive beam body 44 overhangs only the gate contact 34. The insulative element 42 is of sufficient length to provide a mechanical bridge or extension between the conductive beam body 44 and the conductive contact 46 such that the conductive contact 46 overhangs the drain contact 36. In other words, the insulative element 42 provides additional lateral length to the beam structure 38.

In operation, actuation of the switch permits the beam contact 46 to connect the two separate contacts of the drain contact 36 and allow current to flow from one separate drain contact to the other.

The microrelay described above is based on a metallic cantilever beam. When a voltage is applied between the gate and the source electrodes, the electrostatic force between the beam and the gate electrode pulls the free end of the beam down. The free end or the beam contact is mechanically connected to, but electrically isolated from, the rest of the beam by a piece of insulating material, commonly a polyimide. When the beam is pulled down, a pair of contact bumps on the underside of the beam contact closes the path between a pair of thin film electrodes underneath the contact The prior art device described above has some advantages relative to the other prior art devices referred previously. The device is fabricated from a single wafer and does not require wafer-bonding steps. It is fabricated using a surface micromachining process, which is generally simpler than a bulk micromachining process. The fabrication process is also a low temperature process relative to Si micromachining processes and traditional semiconductor fabrication processes. These advantages make it possible to build the device cheaply, and also make it feasible to integrate the device with semiconductor integrated circuits, with minimal interference with the semiconductor fabrication process.

However, a disadvantage of the device is that the material of the insulating segment 42 has to meet a number of requirements, some of which may be contradictory. It should electrically isolate the conductive beam contact 46 from the conductive beam body 44; it should have sufficient mechanical strength and rigidity to prevent excessive bending or breaking of the segment during actuation of the microrelay; it should have good adhesion to the beam body and the beam contact to ensure the mechanical integrity of the device when the microrelay opens and closes repeatedly; it should permit a method of deposition and patterning that is straightforward and compatible with the rest of the fabrication process; and it should be chemically inert so that the microrelay can operate in a hermetic environment without being susceptible to contamination of the contacts by outgassing from the insulating segment.

A practical embodiment of the device with the insulating segment 42 made out of a polyimide has been found to have poor mechanical integrity. More specifically, when the switch opens and closes repeatedly, the polyimide segment 42 loses adhesion with the conductive beam body 44 such that the insulative element 42 along with the conductive beam contact 46 fall off the end of the conductive beam body 44.

It is also possible that when the relay operates in a hermetic environment, the polyimide material will out-gas, particularly during high temperature cycles, and contaminate the microrelay context.

Therefore, it is desirable to design a microrelay wherein fewer requirements are imposed on the electrically insulating material, so that a microrelay with good electrical performance and mechanical integrity can be realized at low cost.

SUMMARY OF THE PRESENT INVENTION

One aspect of the present invention is a micromechanical relay. The micromechanical relay includes a substrate; a source contact mounted on the substrate; a gate contact mounted on the substrate; a pair of drain contacts mounted on the substrate; and a deflectable beam. The deflectable beam includes a conductive beam body having a first end and a second end, the first end of the conductive beam body being attached to the source contact. The conductive beam body extends substantially in parallel to the substrate such that the second end of the conductive beam body extends over both the drain contacts. The deflectable beam also includes a beam contact overhanging the drain contacts and an insulator positioned between the second end of the conductive beam body and the beam contact to join the second end of the conductive beam body to the beam contact and to electrically insulate the conductive beam body from the beam contact.

Another aspect of the present invention is a method for making a micromechanical relay. The method forms a source contact, a gate contact, and a pair of drain contacts upon a substrate; forms a sacrificial region over the source contact, gate contact, drain contact, and substrate; forms a conductive beam contact region on the sacrificial region having the drain contacts thereunder; forms an insulative region over the beam contact region; and forms a conductive beam body on the source contact, the conductive beam body being formed further to extend laterally over the sacrificial region and the insulative region, the formed conductive beam body extending laterally substantially over the source contact, gate contact, and drain contact.

BRIEF DESCRIPTION OF THE DRAWINGS

The present invention may take form in various components and arrangements of components, and in various steps and arrangements of steps. The drawings are only for purposes of illustrating a preferred embodiment and are not to be construed as limiting the present invention, wherein.

DETAILED DESCRIPTION OF THE PRESENT INVENTION

As mentioned above, FIGS. 4 through 15 illustrate a process for constructing an insulated micromechanical switch according to the concepts of the present invention.

Figure 4:
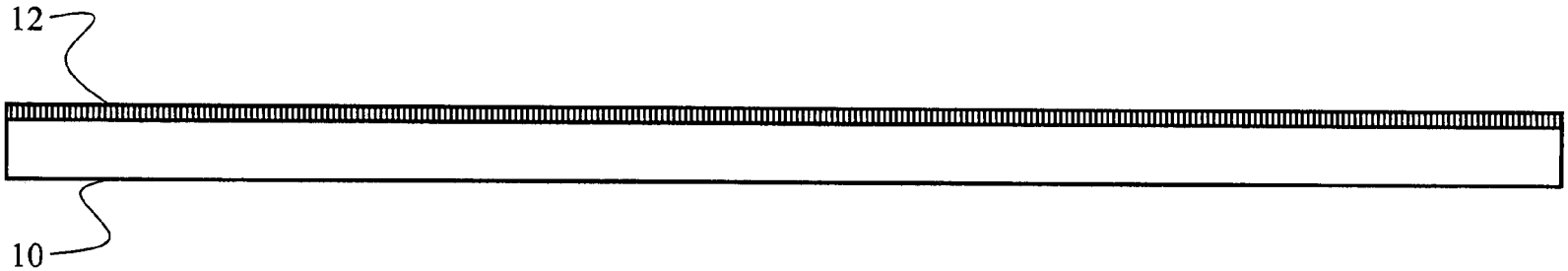
FIGS. 4 and 5 illustrate forming a conductive layer on a substrate and forming contacts therefrom.
Figure 5:
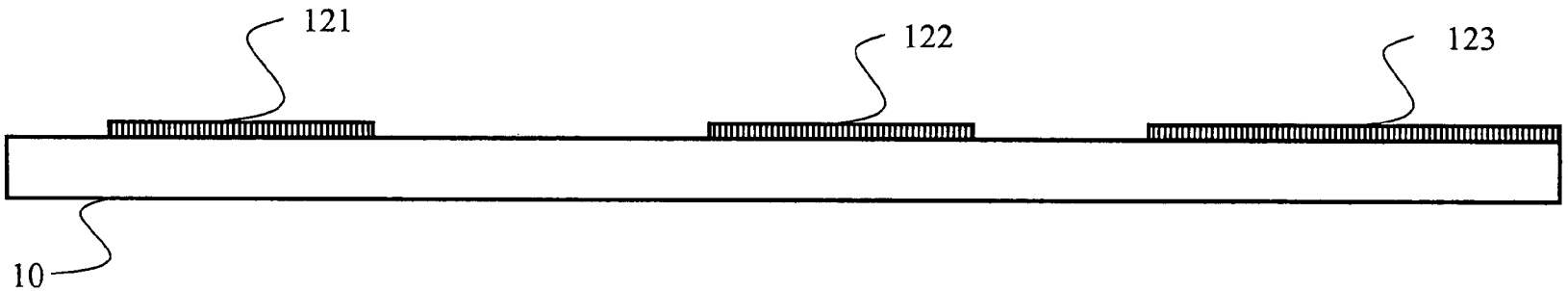
Figure 16:
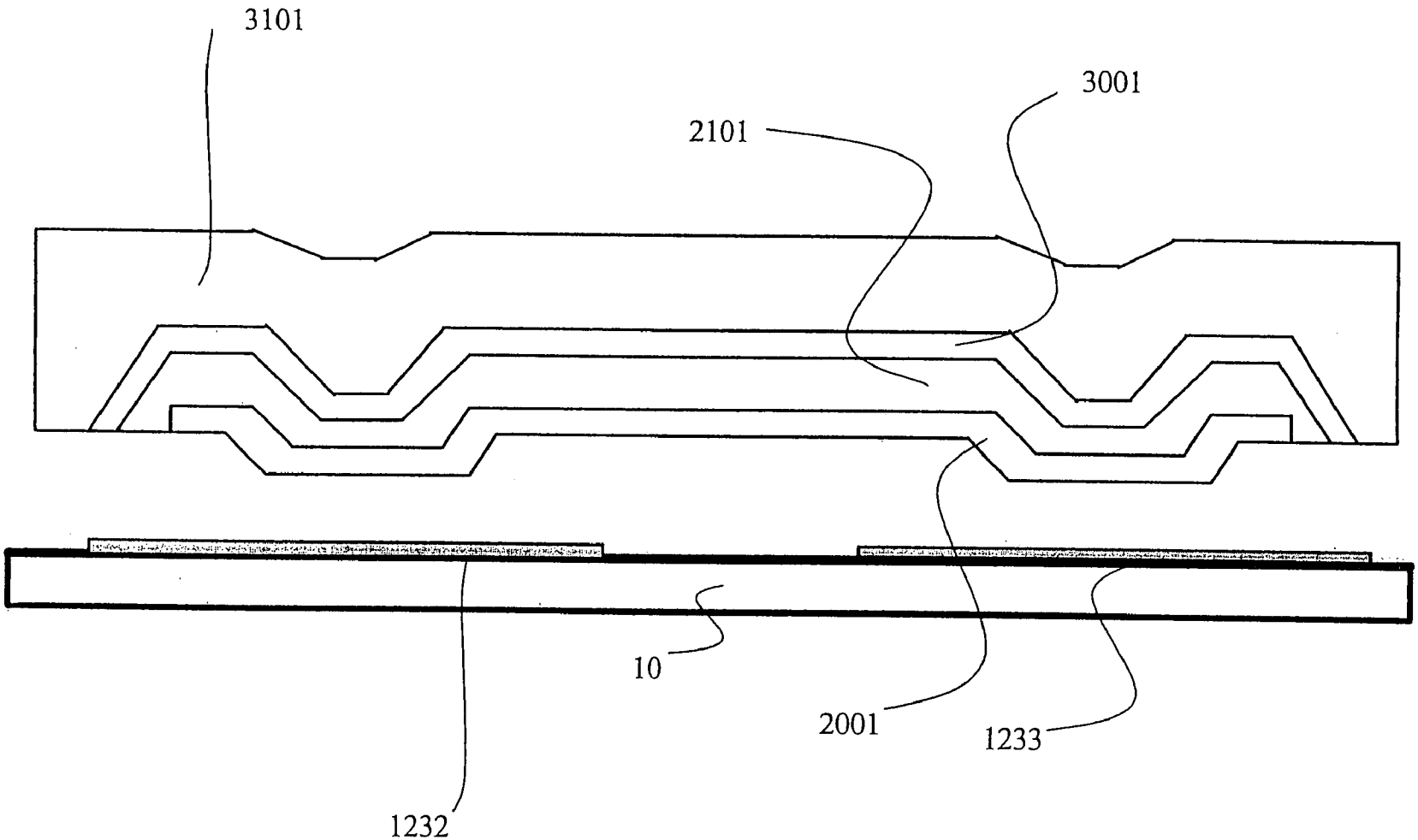
FIG. 16 illustrates the section marked as A–A' in FIG. 15.

More specifically, as illustrated in FIG. 4, a substrate is coated, preferably by vapor deposition, with a metallic substance 12. The metallic substance 12 may be a metal from the group of platinum, palladium, titanium, rhodium, ruthenium, gold, or an alloy containing one of these metals. As illustrated in FIG. 5, certain portions of the metal layer 12 are stripped away by standard photolithographic patterning and dry etching techniques, so that electrodes or contacts 121, 122, and 123 are formed. Electrode 121 forms a source contact for the switch of the present invention. Moreover, electrode 122 forms a gate contact for the switch of the present invention. As illustrated in FIG. 16, the electrode 123 is actually a pair of electrodes 1232 and 1233 such that the switch makes an electrical contact between the electrode pair to complete the electrical circuit.

Figure 6:
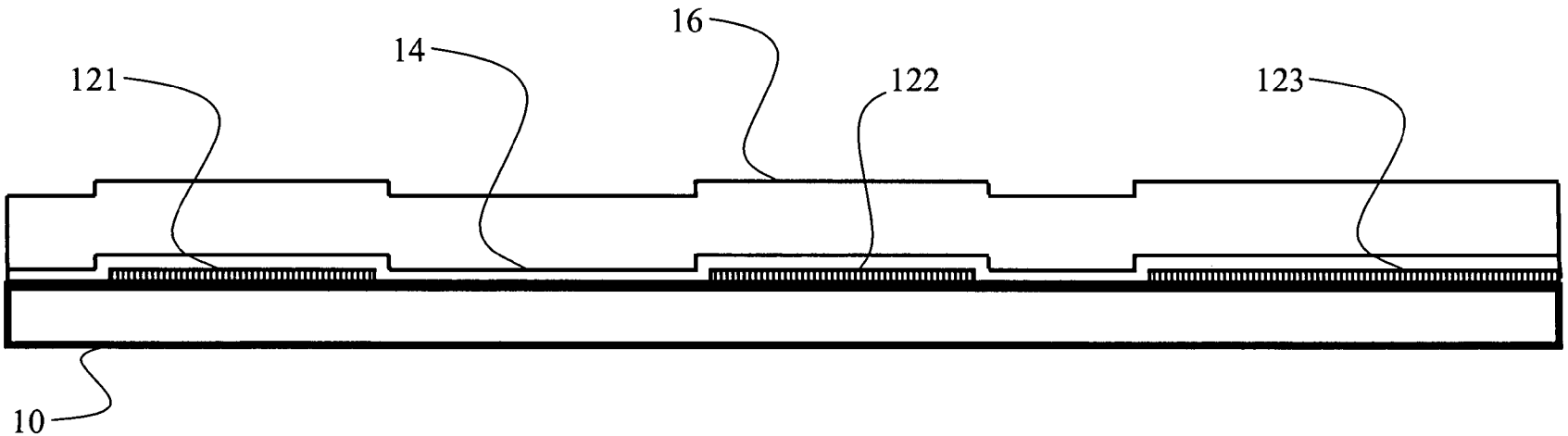
FIG. 6 illustrates forming a sacrificial region over the contacts and substrate.

Upon the formation of the electrodes (contacts) 121, 122, and 123, as illustrated in FIG. 6, a metallic layer 14, which may be titanium or titanium-tungsten, is vapor-deposited upon the substrate 10 and the three electrodes 121, 122, and 123. Upon the metallic layer 14, a further layer of copper 16 is vapor-deposited. The metallic layer 14 promotes adhesion of the copper layer 16 to the underlying substrate. The combination of the metallic adhesion layer 14 and the copper layer 16 forms a sacrificial layer or sacrificial region that will be removed later on in the process.

Figure 7:
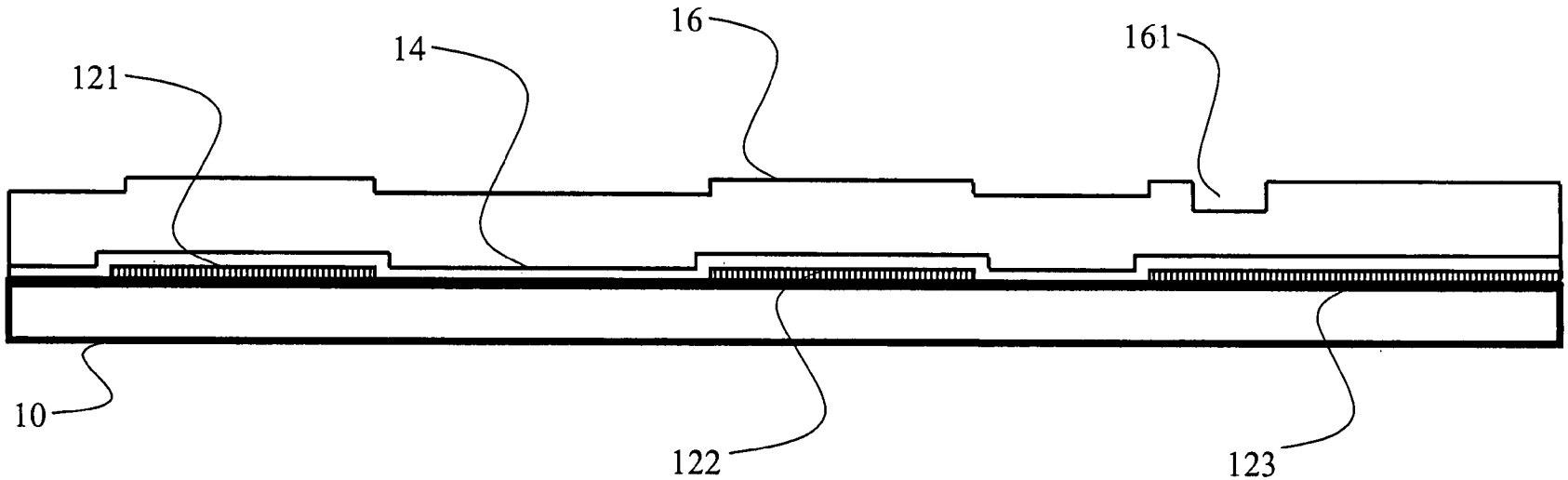
FIG. 7 illustrates etching a well region in the sacrificial region.

FIG. 7 illustrates the formation of a well 161 in the copper substrate 16. This well was formed by covering the copper layer 16 with a photoresist except in the area of the well 161. In the area of the well 161, a portion of the copper layer 16 was stripped away to form the well 161. The well 161 will be used to form a conductive beam contact.

Figure 8:
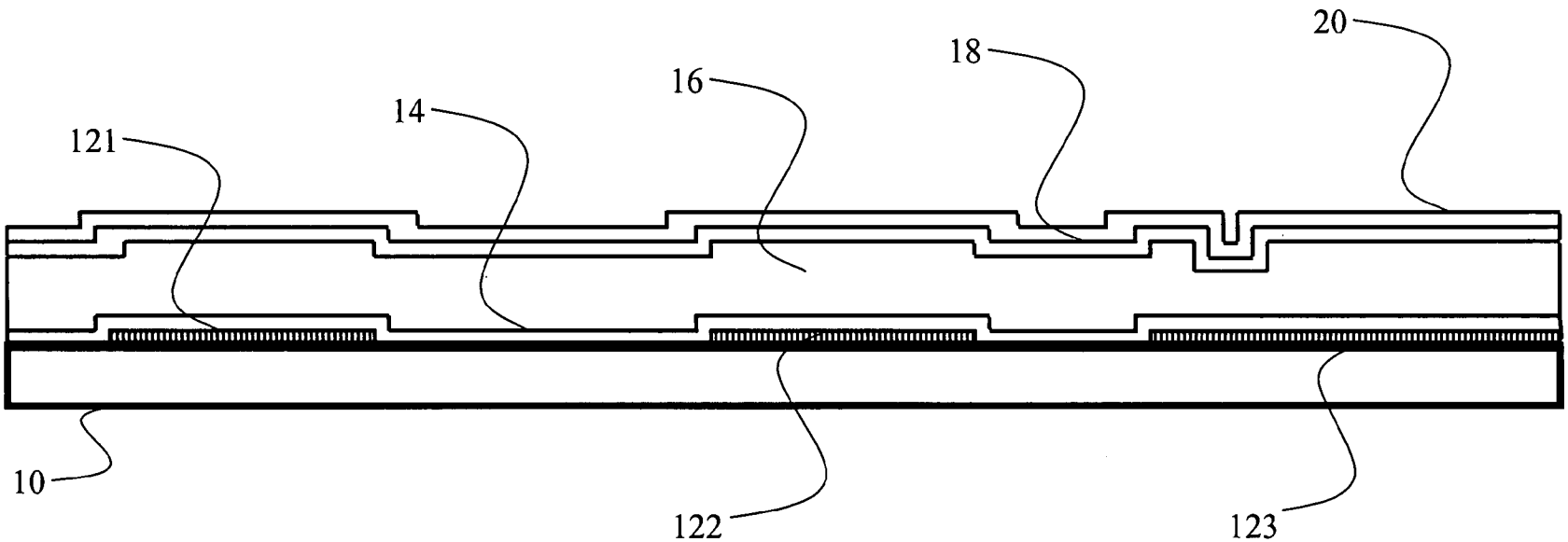
FIG. 8 illustrates forming a conductive region to be used in forming the conductive beam contact region.

After forming the well 161 of FIG. 7, a metallic layer 18, which may be titanium or titanium-tungsten, is vapor-deposited upon the copper layer 16, as illustrated in FIG. 8. This metallic layer promotes adhesion between the underlying copper layer 16, and metallic layers to be deposited subsequently. Furthermore, as illustrated in FIG. 8, a layer 20, from the group of platinum, palladium, titanium, rhodium, ruthenium, gold, or an alloy containing one of these metals, is vapor-deposited upon the metallic adhesion layer 18.

Figure 9:
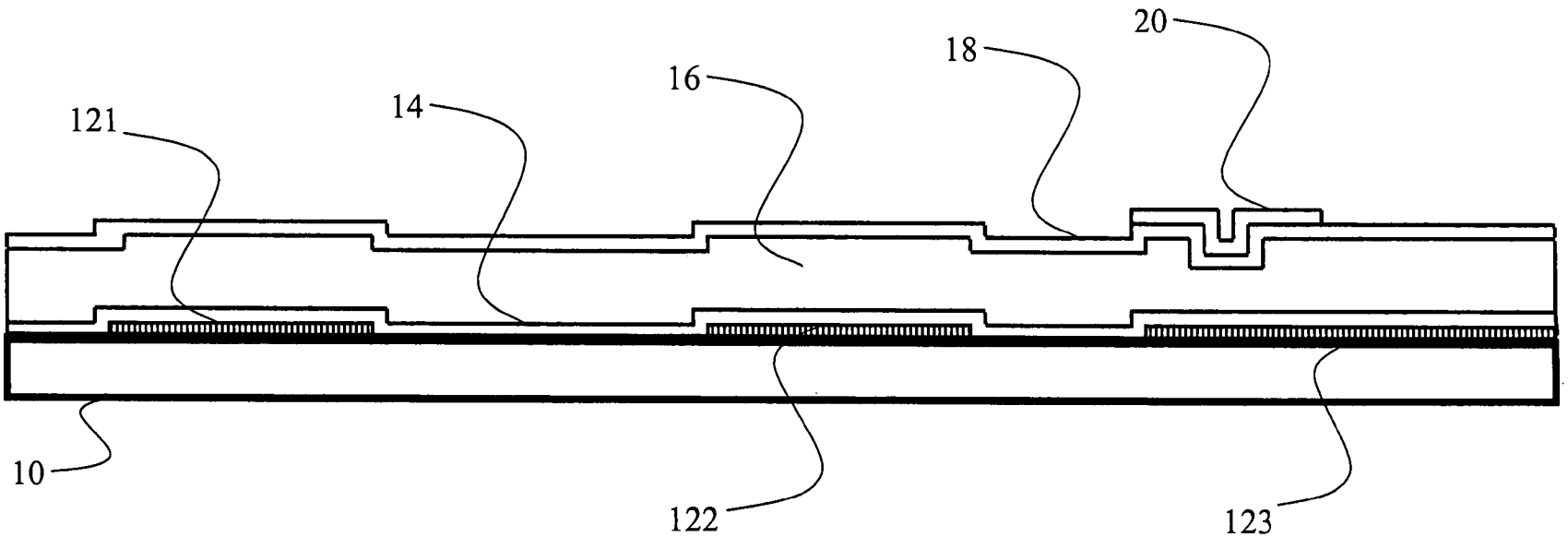
FIG. 9 illustrates forming the conductive beam contact region.

FIG. 9 illustrates the formation of a metal contact, from layer 20, of the switch used to make the electrical connection between the pair of drain electrodes represented by drain electrode 123. Using standard photolithographic and dry-etching techniques, a portion of the metal layer 20 from FIG. 8 is stripped away so as to form a layer 20, which corresponds solely to the well area 161.

Figure 10:
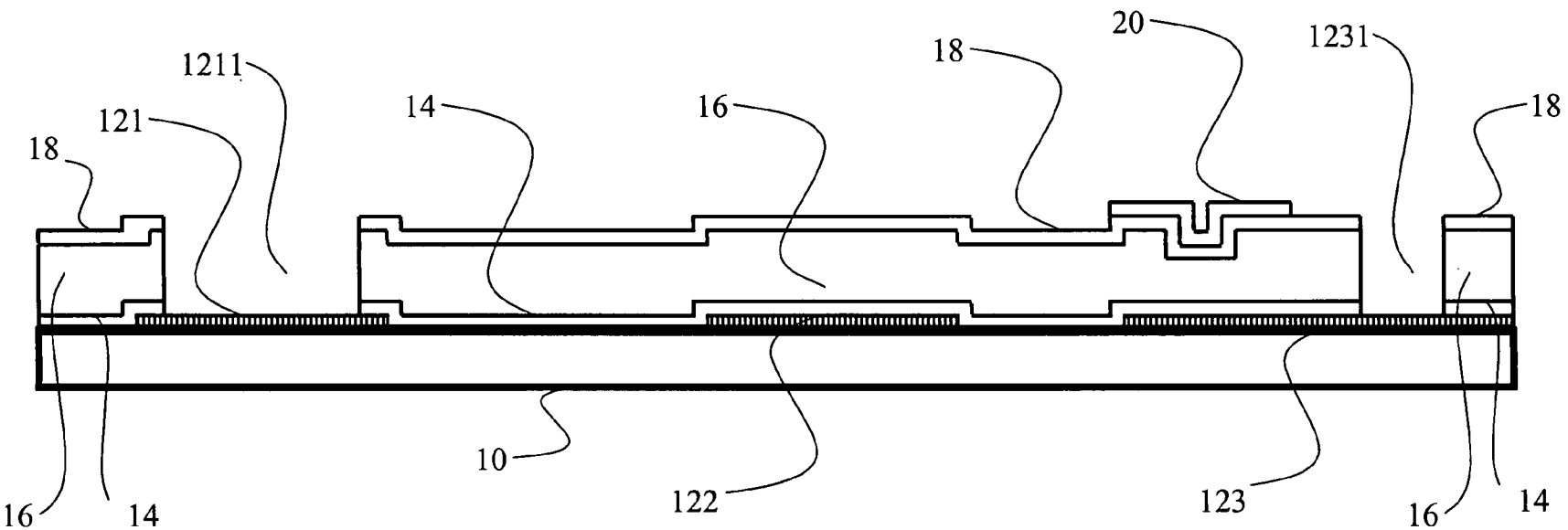
FIG. 10 illustrates etching to prepare for forming the conductive beam body and an external connector to the drain contact region.

In FIG. 10, the layers 14, 16, and 18 have been stripped away using standard photolithographic and dry-etching techniques to form a well 1211 corresponding to the source contact 121. The well 1211 will be used to contact the conductive beam body to the source contact 121.

After forming the wells 1211 and 1231 of FIG. 10, an insulative layer 21 is deposited. A metallic layer 211, which may be titanium or titanium-tungsten, is vapor-deposited on top of the insulating layer. The metal layer 211 promotes adhesion between the insulating layer 21, and the beam layer, which is deposited subsequently. Portions of layers 21 and 211 are removed using standard photolithographic and dry-etching techniques, so that an insulating region is formed over and around the beam contact region or metallic layer 20. This insulative layer 21, in the preferred embodiment, is aluminum oxide. However, it is noted that any insulative layer may be suitable, such as silicon oxide or silicon nitride.

Figure 11:
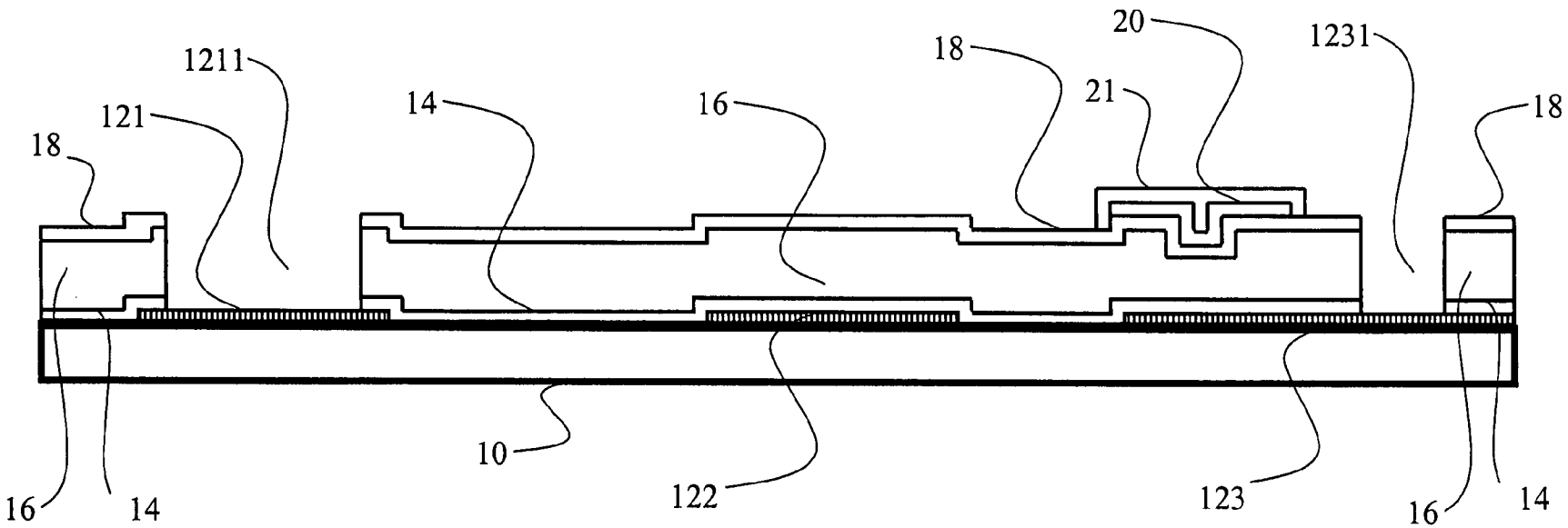
FIG. 11 illustrates forming an insulative region over the conductive beam contact region.
Figure 12:
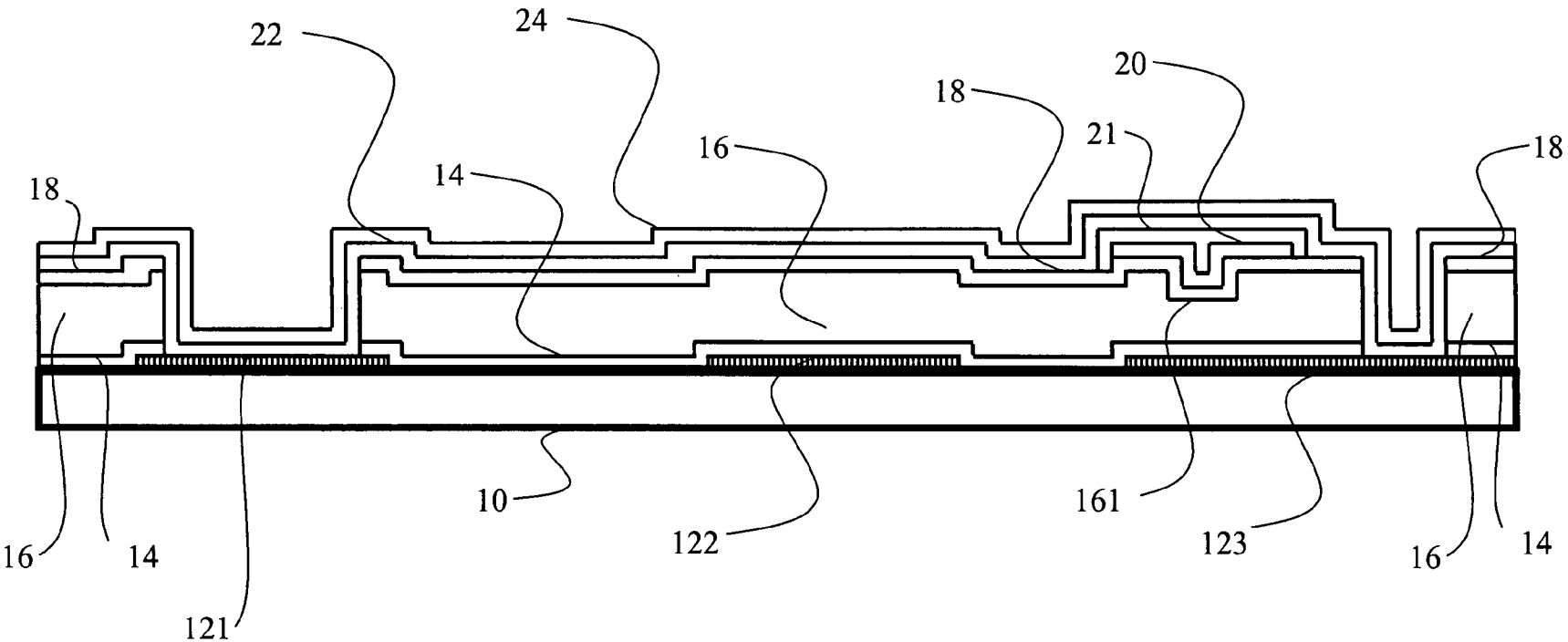
FIG. 12 illustrates forming a conductive region to be used in forming the conductive beam body and external connector to the drain contact region.

The formation of the insulative layer 21 is illustrated in FIG. 11. Thereafter, a layer of gold 22 and a metallic layer 24, which may be titanium or titanium-tungsten, are vapor-deposited over the entire device, as illustrated in FIG. 12. The gold layer 22 serves as a seed layer for subsequent formation of the beam by electroplating. The metallic layer 24 protects the underlying gold layer 22 during the processing steps immediately following FIG. 12, and is removed prior to formation of the beam by electroplating.

Figure 13:
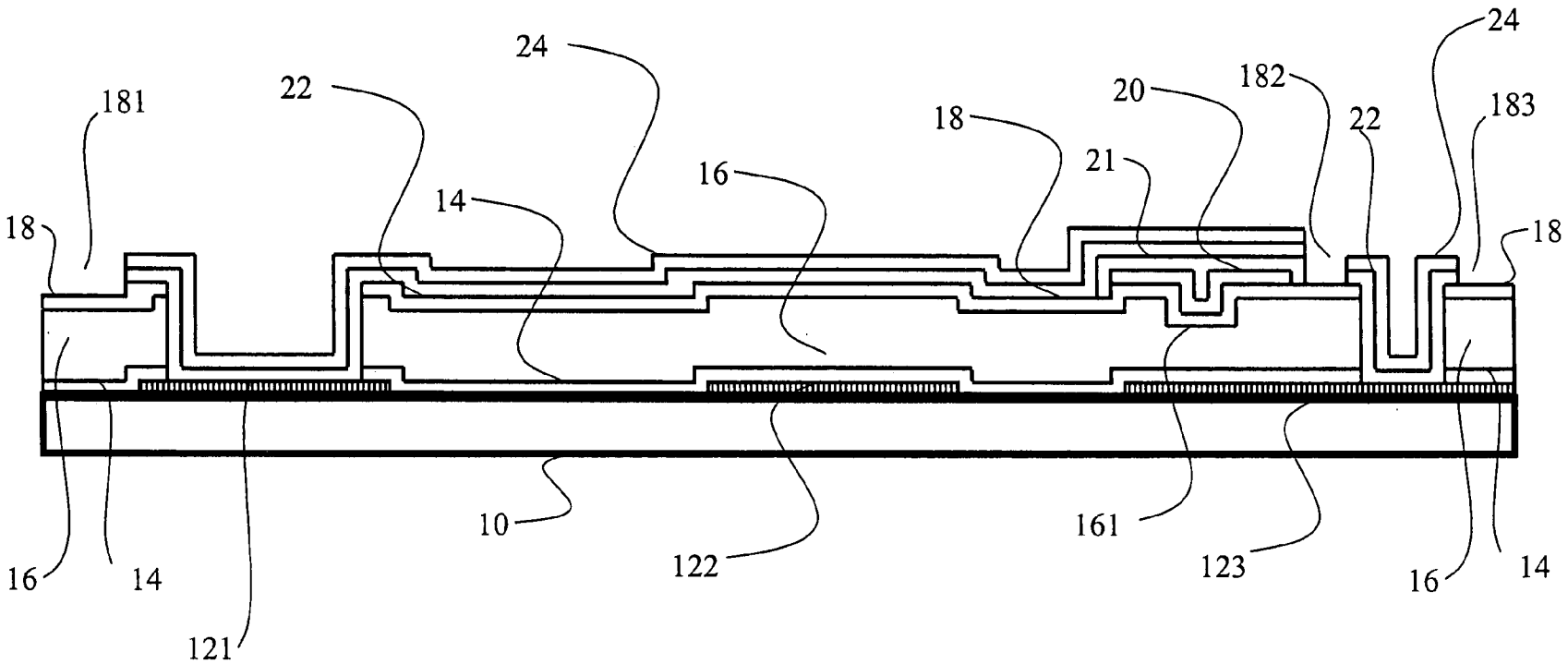
FIG. 13 illustrates etching to electrically isolate the conductive beam body from the external connector to the drain contact region.
Figure 14:
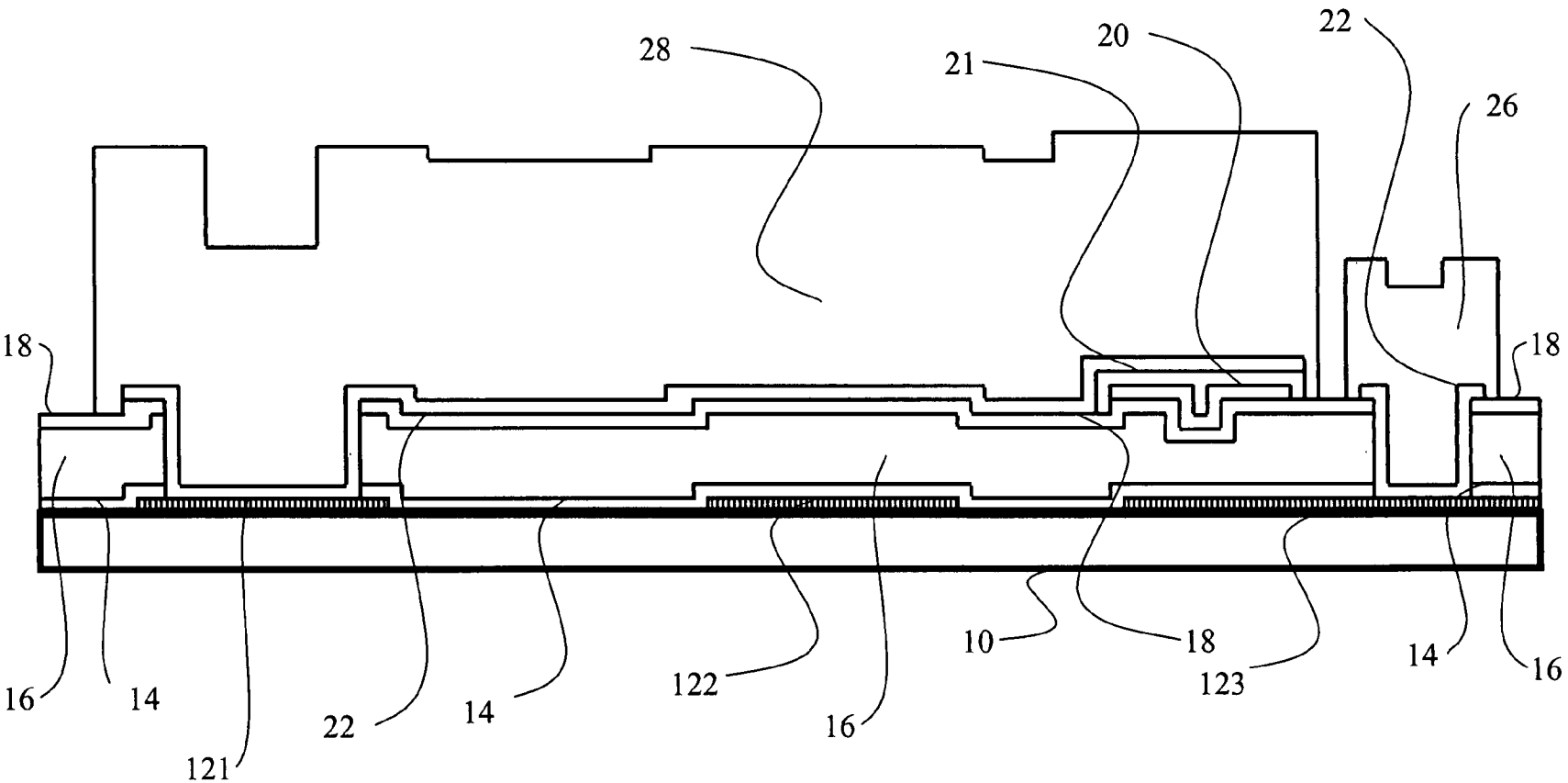
FIG. 14 illustrates forming further conductive regions to be used in forming the conductive beam body and external connector to the drain contact region.

In FIG. 13, the gold layer 22 and the titanium layer 24 have been selectively stripped away by standard photolithographic and dry-etching techniques, to form wells 181 and 182. These wells define the spaces, which will eventually separate the beam from other structures. FIG. 14 illustrates the formation of the cantilever beam 28. This is carried out by first depositing a photoresist layer, and selectively stripping away a portion of it using standard photolithography. The protective layer 24 is then etched away from the section of the device not covered by photoresist. A thick gold layer is then deposited by electroplating in the section of the device not covered by photoresist, and the photoresist is stripped away.

Figure 15:
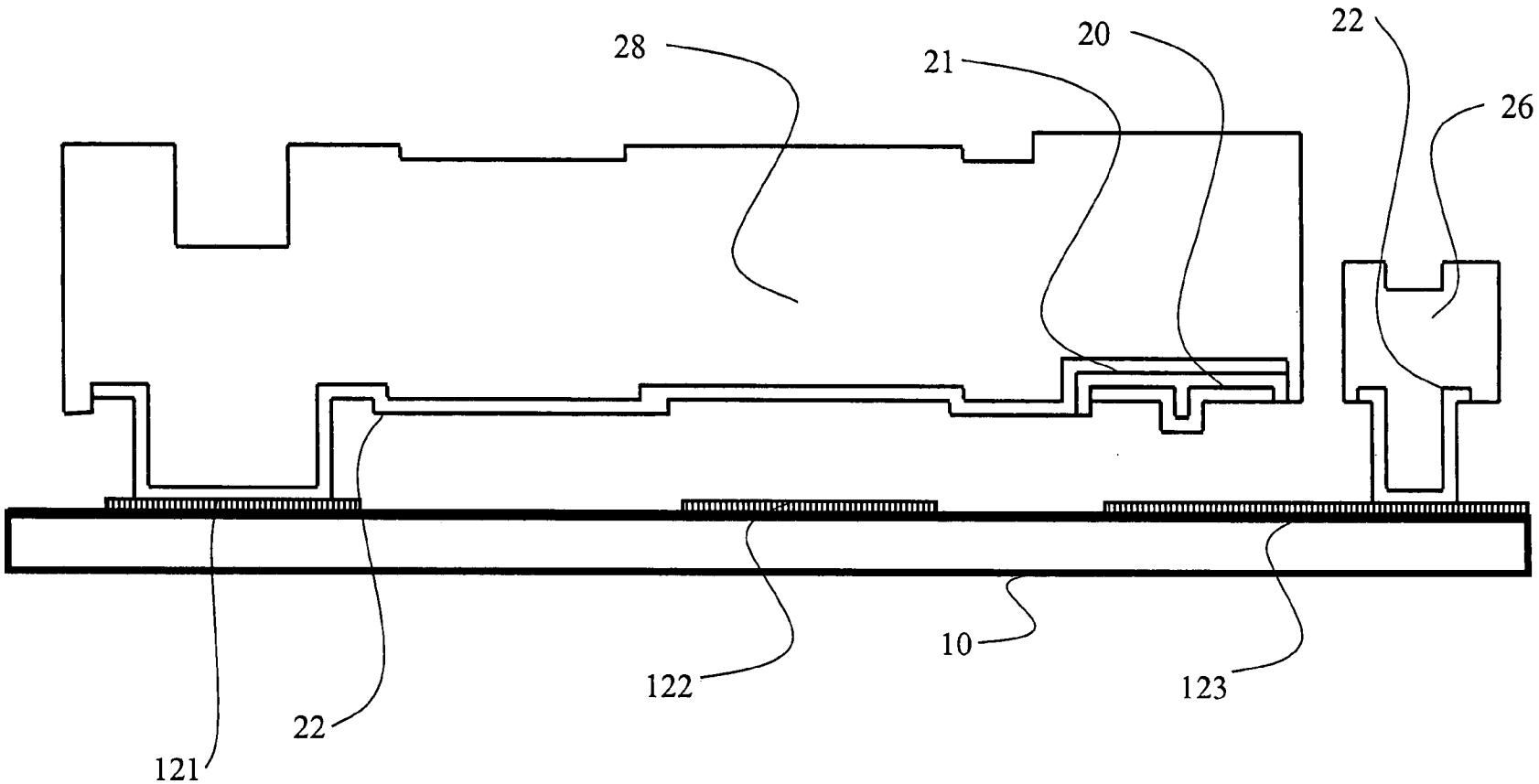
FIG. 15 illustrates one embodiment of an insulated micromechanical switch according to the concepts of the present invention.

FIG. 15 illustrates the completion of the construction of the insulated micromechanical switch, according to the concepts of the present invention, wherein the sacrificial layers of copper 16 and the adhesion metals 14 and 18 have been stripped away, thereby leaving a free-standing cantilever beam substantially made up of the plated gold layer 28, and the vapor-deposited gold layer 22. Moreover, the micromechanical relay includes the insulative layer 21, preferably aluminum oxide, which is formed between the gold layer 22 and a contact layer 20.

FIG. 16 illustrates the section identified as A–A' in FIG. 15. As illustrated in FIG. 16, the substrate 10 has formed thereon the drain electrode pair 1232 and 1233. Above the drain electrode pair 1232 and 1233 is the contact layer 2001. Between the contact layer 2001 and the conductive beam body 3101 of the micromechanical switch is an insulative layer 2101 and a metallic adhesive layer 3001.

It is noted that when the microrelay is actuated, the conductive beam body, represented by plated gold 28 and the gold layer 22, bends downward to bridge the distance between the beam contact 20 and the drain electrodes 123. During this process, there is little or no bending of the insulating layer 21. This is because the insulating layer is above, and substantially parallel to, the beam contact 20.

Figure 1:
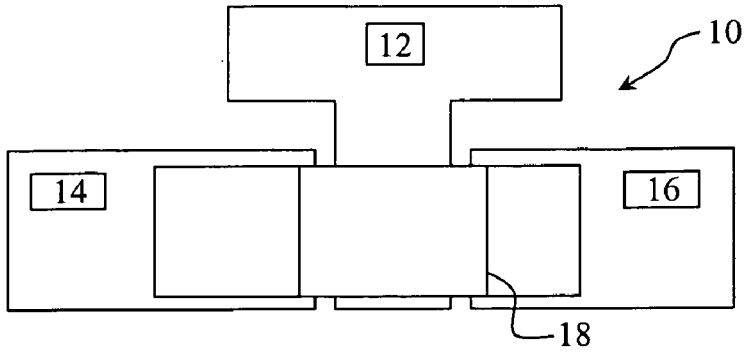
FIGURE 1 (PRIOR ART)
FIGS. 1–3 illustrates prior art micromechanical switches.
Figure 2:
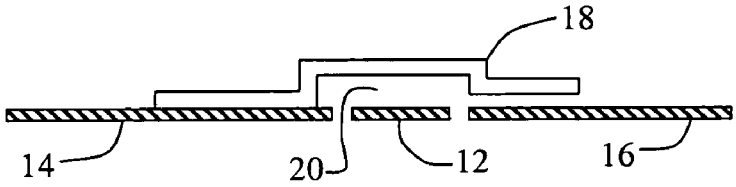
FIGURE 2 (PRIOR ART)
Figure 3:
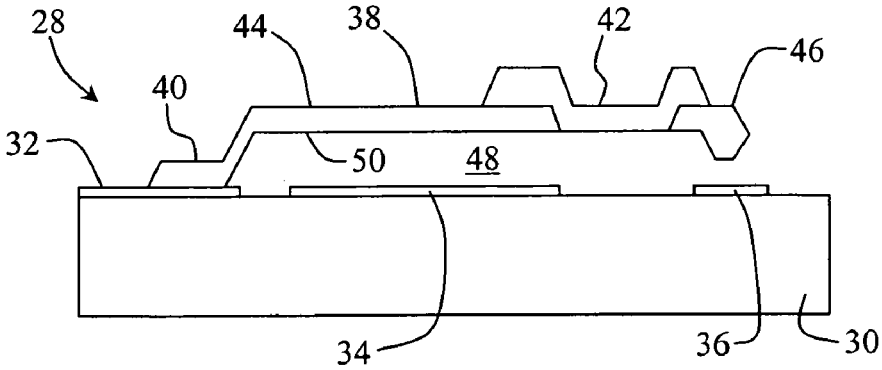
FIGURE 3 (PRIOR ART)

In contrast, in the prior art of FIG. 3, there is substantial bending of the insulating segment 42 during actuation, because the insulating region extends laterally from the beam body 44, and is substantially co-planar with the beam body 44 and the beam contact 46. Therefore, in the present invention, the insulating layer is subject to smaller stresses than in the prior art design shown in FIG. 3.

Referring to FIG. 15, it is noted that the insulating layer 21 in this embodiment of the present invention is substantially enclosed by the beam body 28 and the beam contact 20. In contrast, in the prior art of FIG. 3, only the bottom surface of the insulating layer 42 is attached to the beam body 44 and the beam contact 46. Therefore, the insulating segment has inherently better adhesion to the beam body and the beam contact in the present invention, than in the prior art of FIG. 3.

Due to the smaller stresses and larger attachment area of the insulating layer, the present invention provides improved mechanical integrity such that when the switch opens and closes repeatedly, the insulating layer is less prone to breaking or losing adhesion with the beam. For the same reasons, the requirements imposed on the insulating material, of high mechanical strength and rigidity and good adhesion to the beam material, are less stringent in the present invention than in the prior art design. This makes it possible to consider a wider variety of materials, particularly inorganic materials such as aluminum oxide, for use in the insulating layer. The use of an inorganic material reduces the danger of contaminating the contacts.

As explained above, a contact bar layer or multiple layers is deposited in pattern immediately after the contact tip edge is established. An electrically insulating layer, for example, aluminum oxide, is next deposited, followed by a metallic adhesive layer. The insulator and adhesive layers are then patterned to enclose the contact bar and isolate it from the plated beam. This construction makes it possible to form the insulating region with minimal additions and modifications to the remainder of the microrelay process flow. Moreover, this construction makes it possible to form the insulative region with minimal modification to the electromechanical properties of the cantilever beam, facilitating easy design of the cantilever beam.

In summary, a micromechanical relay includes a substrate; a source contact mounted on the substrate; a gate contact mounted on the substrate; a pair of drain contacts mounted on the substrate; and a deflectable beam. The deflectable beam includes a conductive beam body having a first end and a second end. The first end of the conductive beam body is attached to the source contact. The conductive beam body extends substantially in parallel to the substrate such that the second end of the conductive beam body extends over both the gate contact and the drain contacts. The deflectable beam further includes a beam contact overhanging the drain contacts and an insulator positioned between the second end of the conductive beam body and the beam contact to join the second end of the conductive beam body to the beam contact and to electrically insulate the conductive beam body from the beam contact.

The beam is deflectable by an electric field established between the gate electrode and the conductive beam body. The beam is deflectable to a first position, the first position being when the beam contact is in electrical communication with the drain contacts in response to an electrical field of a first strength established between the gate electrode and the conductive beam body. In this position, the relay is "on", and electrical current can flow between the pair of drain contacts in response to a voltage applied across the drain contacts. The deflectable beam is deflectable to a second position, the second position being when the beam contact is electrically isolated from the drain contacts in response to an electrical field of a second strength established between the gate electrode and the conductive beam body. In this position, the relay is "off", and no current can flow between the drain contacts.

As noted before the substrate may comprise oxidized silicon or glass; the deflectable beam body may comprise nickel, gold, titanium, chrome, chromium, copper, or iron; the insulator may comprise polyimide, PMMA, silicon nitride, silicon oxide, or aluminum oxide; and the source electrode (contact), gate electrode (contact), and drain electrode (contact) may comprise platinum, palladium, titanium, tungsten, rhodium, ruthenium, or gold.

While various examples and embodiments of the present invention have been shown and described, it will be appreciated by those skilled in the art that the spirit and scope of the present invention are not limited to the specific description and drawings herein, but extend to various modifications and changes all as set forth in the following claims.

What is claimed is:

1. A micromechanical relay comprising:

a substrate;

a source contact mounted on said substrate;

a gate contact mounted on said substrate;

a pair of drain contacts mounted on said substrate; and a metallic deflectable beam;

said metallic deflectable beam including, a metallic conductive beam body having a first end and a second end, said first end of said metallic conductive beam body being attached to said source contact, said metallic conductive beam body extending substantially in parallel to said substrate such that said second end of said metallic conductive beam body extends over said drain contacts, a beam contact overhanging said drain contacts, and an insulator positioned between said second end of said metallic conductive beam body and said beam contact to join said second end of said metallic conductive beam body to said beam contact and to electrically insulate said metallic conductive beam body from said beam contact;

said second end of said metallic conductive beam body, said beam contact, and said insulator forming stacked planar layers.

2. The micromechanical relay as claimed in claim 1, wherein said metallic deflectable beam is deflectable to a first position, said first position being when said beam contact is in electrical communication with said drain contact in response to an electrical field of a first strength established between said gate electrode and said metallic conductive beam body;

said metallic deflectable beam being deflectable to a second position, said second position being when said beam contact is electrically isolated from said drain contact in response to an electrical field of a second strength established between said gate electrode and said metallic conductive beam body.

3. The micromechanical relay as claimed in claim 1, wherein said substrate comprises oxidized silicon or glass.

4. The micromechanical relay as claimed in claim 1, wherein said metallic deflectable beam body comprises nickel, gold, titanium, chromium, copper, or iron.

5. The micromechanical relay as claimed in claim 1, wherein said insulator comprises polyimide or PMMA.

6. The micromechanical relay as claimed in claim 1, wherein said insulator comprises silicon nitride, silicon oxide, or aluminum oxide.

7. The micromechanical relay as claimed in claim 1, wherein said drain contact comprises platinum, palladium, titanium, tungsten, rhodium, ruthenium, or gold.

8. The micromechanical relay as claimed in claim 1, wherein said gate contact comprises platinum, palladium, titanium, tungsten, rhodium, ruthenium, or gold.

9. The micromechanical relay as claimed in claim 1, wherein said source contact comprises platinum, palladium, titanium, tungsten, rhodium, ruthenium, or gold.

10. The micromechanical relay as claimed in claim 1, wherein said micromechanical relay is incorporated into an electrical circuit.

11. A method for making a micromechanical relay, comprising:

(a) forming a source contact, a gate contact, and a pair of drain contacts upon a substrate;

(b) forming a sacrificial region over the source contact, gate contact, drain contacts, and substrate;

(c) forming a conductive beam contact region on the sacrificial region having the drain contacts thereunder;

(d) forming an insulative region over the beam contact region; and (e) forming a metallic conductive beam body on the source contact, the metallic conductive beam body being formed further to extend laterally over the sacrificial region and the insulative region such that the metallic conductive beam body, the beam contact region, and the insulative region form stacked planar layers, the formed metallic conductive beam body extending laterally substantially over the source contact, gate contact, and drain contacts.

12. The method as claimed in claim 11, wherein the substrate comprises oxidized silicon or glass.

13. The method as claimed in claim 11, wherein the metallic conductive beam body comprises nickel, gold, titanium, chrome, chromium, copper, or iron.

14. The method as claimed in claim 11, wherein the insulative region comprises polyimide or PMMA.

15. The method as claimed in claim 11, wherein the insulative region comprises silicon nitride, silicon oxide, or aluminum oxide.

16. The method as claimed in claim 11, wherein the drain contact comprises platinum, palladium, titanium, tungsten, rhodium, ruthenium, or gold.

17. The method as claimed in claim 11, wherein the gate contact comprises platinum, palladium, titanium, tungsten, rhodium, ruthenium, or gold.

18. The method as claimed in claim 11, wherein the source contact comprises platinum, palladium, titanium, tungsten, rhodium, ruthenium, or gold.

19. The method as claimed in claim 11, wherein the sacrificial region comprises titanium, titanium-tungsten, or copper.

* * * * *